US007441971B2

(12) United States Patent
Pomfret

(10) Patent No.: US 7,441,971 B2
(45) **Date of Patent: *Oct. 28, 2008**

(54) INKED RIBBON CORE WITH RIBS

(75) Inventor: John A. Pomfret, East Lyme, CT (US)

(73) Assignee: Cartec International, Inc., Canton, CT (US)

( * ) Notice: Subject to any disclaimer, the term of this patent is extended or adjusted under 35 U.S.C. 154(b) by 161 days.

This patent is subject to a terminal disclaimer.

(21) Appl. No.: 11/156,818

(22) Filed: Jun. 20, 2005

(65) Prior Publication Data

US 2005/0249537 A1 Nov. 10, 2005

Related U.S. Application Data

(63) Continuation-in-part of application No. 10/691,288, filed on Oct. 21, 2003, now Pat. No. 6,923,582.

(51) Int. Cl.
*B65H 75/02* (2006.01)

(52) U.S. Cl. ..... 400/242; 400/207; 242/611.2; 242/613

(58) Field of Classification Search ..... 101/375; 400/242, 207, 208
See application file for complete search history.

(56) References Cited

U.S. PATENT DOCUMENTS

| | | | | |
|---|---|---|---|---|
| 2,585,999 | A * | 2/1952 | Bunch | 242/597.6 |
| 3,106,363 | A * | 10/1963 | Epstein | 242/611.2 |
| 3,207,454 | A * | 9/1965 | Bendar | 242/597.2 |
| 3,433,355 | A * | 3/1969 | Smith | 242/613 |
| D252,755 | S * | 8/1979 | Sato | D19/67 |
| 5,439,303 | A * | 8/1995 | Alday | 400/242 |
| 5,833,377 | A * | 11/1998 | Keller et al. | 400/208 |
| 6,109,801 | A * | 8/2000 | Mabit | 400/242 |
| 6,425,548 | B2 * | 7/2002 | Christensen et al. | 400/242 |
| 6,425,551 | B1 * | 7/2002 | Puckett et al. | 242/611.2 |
| 6,609,678 | B2 * | 8/2003 | Seybold et al. | 400/242 |
| 6,666,597 | B1 * | 12/2003 | Neri et al. | 400/223 |
| 6,923,582 | B2 * | 8/2005 | Pomfret | 400/242 |
| 2003/0127555 | A1 * | 7/2003 | Squires | 242/597.6 |
| 2005/0092865 | A1 * | 5/2005 | Neri | 242/613 |

* cited by examiner

*Primary Examiner*—Jill E. Culler
(74) *Attorney, Agent, or Firm*—Ira S. Dorman

(57) ABSTRACT

An inked ribbon core is formed with interference structure, providing an internal cylindrical contact surface, and a longitudinal rib, the interference structure and rib frictionally engaging corresponding spindle structures to secure the core on the spindle.

16 Claims, 1 Drawing Sheet

FIG. 1
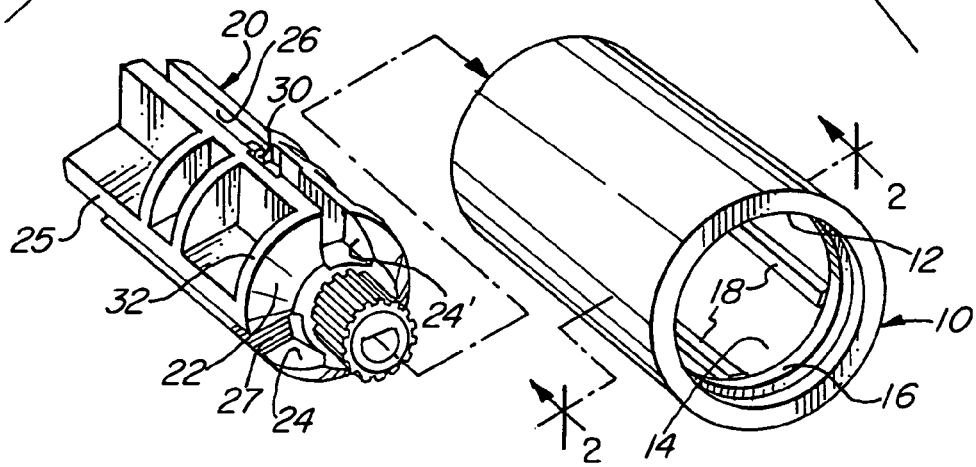
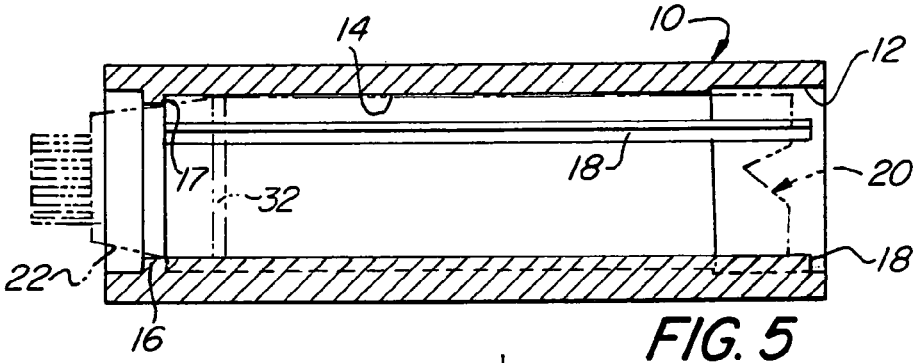
FIG. 5
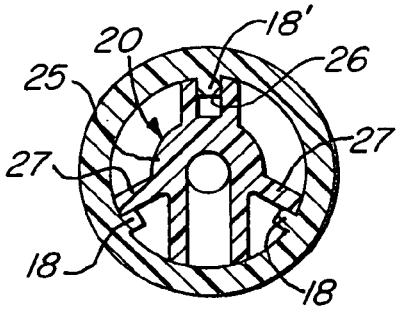
FIG. 2
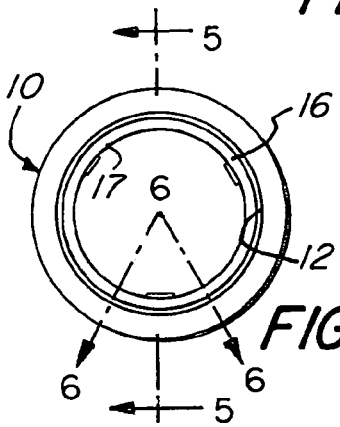
FIG. 3
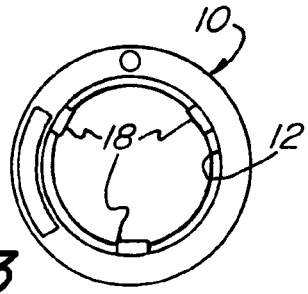
FIG. 4
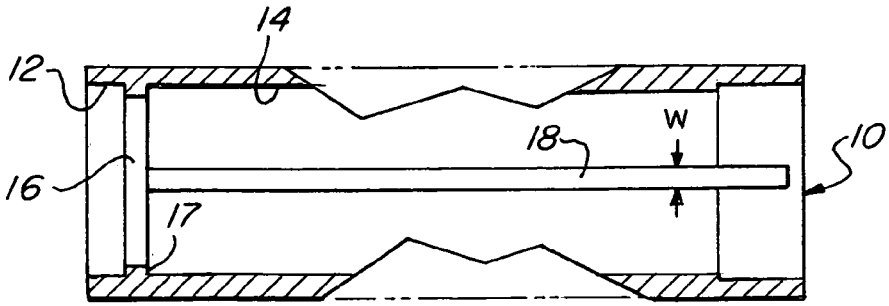
FIG. 6

INKED RIBBON CORE WITH RIBS

CROSS REFERENCE TO RELATED APPLICATION

This application is a continuation-in-part of U.S. patent application Ser. No. 10/691,288, filed Oct. 21, 2003, and now issued as U.S. Pat. No. 6,923,582.

BACKGROUND OF THE INVENTION

Printing machines of the kind described for example in Keller et al. U.S. Pat. No. 5,833,377 utilize a thermal transfer "inked" ribbon wound upon a core, the core in turn being mounted upon a spindle of the machine (see for example FIG. 4 of the patent). The spindle may have a plurality of longitudinal grooves and/or walls that engage corresponding ribs on the inside of the core to lock the core against relative rotation on the spindle. The spindle and core may also have cooperating means for limiting the depth to which the spindle can be inserted into the core, and for maintaining the core in its fully mounted position. The limiting and securing means described by Keller et al. take the form of a ramp and stop face, centrally located on the ribs of the core, which coact, respectively, with an abutment and a resilient spring finger disposed in a groove of the spindle.

SUMMARY OF THE INVENTION

Despite extensive prior art activity and the commercial availability of a considerable variety of suitable products, a need remains for an inked ribbon core, generally of the kind disclosed by Keller et al. but that is improved thereupon in at least certain respects, that is of incomplex and economical construction, that is readily mounted upon and dismounted from printer spindles of various forms, and that enables reliable and stable positioning of the core on the spindle while affording secure support for the inked ribbon wound thereupon. Accordingly, the broad objects of the invention are to provide a ribbon core having the foregoing features and advantages, and a core and spindle assembly utilizing the same.

It has now been found that certain of the foregoing and related objects of the invention are attained by the provision of a spindle-mountable core comprising a tubular body having opposite ends, an outer surface for receiving and supporting a length of web material wound thereupon, and a bore through the body for receiving a spindle inserted from the aft end (i.e., the end of the core closest to the printer, as mounted). A plurality of circumferentially spaced ribs extend axially along the bore, and radially inwardly from the body, for slidable engagement in or against corresponding groove structure on the outer surface of a mounting spindle, each rib preferably being of uniform circumferential width along its entire effective length (i.e., the length along which it would frictionally engage the groove-defining structure of the spindle, if engaged therewith). Stop means is provided on the body within the bore (normally adjacent to, but spaced axially from, the fore end of the body) for engaging the spindle so as to limit the depth of insertion and thereby define a fully mounted position; and interference structure, circumscribing the bore, provides a substantially cylindrical contact surface for frictional engagement with circumferentially disposed external contact means on the spindle in the fully mounted core position, the interference structure extending along a major portion of the bore, from adjacent the stop means toward the aft end of the body.

Preferably, the core of the invention will be devoid of spindle-engaging elements other than the ribs, the stop means and the cylindrical contact surface. The interference structure will normally be of substantially uniform radial thickness and, except where it is interrupted by the ribs, the contact surface will most desirably be continuous. The stop means will preferably provide a circumferential shoulder disposed radially inwardly of the contact surface of the interference structure, most desirably taking the form of ring structure on the inside surface of the body and effectively circumscribing the bore adjacent the fore end of the body; the ring structure will normally be of substantially uniform radial thickness, greater than the thickness of the interference structure. The body of the core will most desirably be formed to provide an enlarged-diameter cylindrical lead-in section extending inwardly from the aft end and along a minor portion of the bore, to facilitate loading of the core onto a printer spindle.

Other objects of the invention are attained by the provision of an assembly comprised of an elongate spindle and a web material-supporting core, the latter being constructed as herein described. The spindle includes a forward end portion having circumferentially disposed external contact means thereon, and a shaft portion having such contact means as well as groove structure (i.e., either a slot defined by two parallel walls, or a single wall) that opens forwardly and radially outwardly. The ribs on the core are slidably engaged in or against the groove structure of the spindle, and the stop means on the core engages the spindle so as to limit the depth of insertion; the interference structure on the inside surface of the body frictionally engages the circumferentially disposed external contact means on the spindle, for retention of the core in its fully mounted position.

In most embodiments the groove structure on the spindle will define at least one slot and the ribs on the core will be dimensioned and configured to frictionally engage therein, thereby cooperating with the interference structure and spindle contact means for maintaining the the core in its fully mounted position. The ribs will normally be of highly uniform circumferential width along their entire effective length, and the groove structure will normally extend through the forward end portion of the spindle as well as along the shaft portion. Typically, the rib and slot-defining structure, and the interference structure and spindle contact means, will function cooperatively to together provide a holding force of about 4 to 6 pounds for retaining the core against axial displacement on the spindle.

BRIEF DESCRIPTION OF THE DRAWINGS

FIG. 1 is an exploded perspective view showing the components of an inked ribbon roll-supporting assembly embodying the present invention;

FIG. 2 is a sectional view, taken along line 2-2 of FIG. 1, showing the core of the assembly, fully mounted on the spindle;

FIG. 3 is a fore end view of the core of the foregoing figures;

FIG. 4 is an aft end view of the core;

FIG. 5 is a sectional view of the core, taken along line 5-5 in FIG. 3 and additionally showing, in phantom line, the mounting spindle; and FIG. 6 is a fragmentary sectional view taken along line 6-6-6 in FIG. 3.

DETAILED DESCRIPTION OF THE PREFERRED AND ILLUSTRATED EMBODIMENT

Turning now in detail to the appended drawings, it is seen that the ribbon-supporting core of the present invention consists of a cylindrical body, generally designated by the numeral 10, having a bore extending from end-to-end therethrough. The bore is of constant diameter along most of its length, defining interference structure that provides a substantially cylindrical contact surface 14, but has short, enlarged-diameter axial sections 12, 12' adjacent the fore and aft ends of the core, respectively, the latter providing a lead-in section to facilitate installation of the core (which can be quite heavy and cumbersome when it is fully wound with a ribbon). A ring-like element 16, contiguous to the contact surface 14 and adjacent to (but spaced axially from) the fore end of the spindle, provides a stop for limiting the depth to which a printer spindle can be inserted into the bore. Three ribs 18 extend, at equiangularly spaced (120°) circumferential locations, from adjacent the aft end of the body 10 to the stop ring 16; they are of constant width along their entire lengths.

As is best seen in FIG. 1, the spindle consists of a body, generally designated by the numeral 20, having a frustoconical leading end portion 22 through which extend three slots 24 (only two of which are visible), disposed at 120° circumferentially spaced positions. One of the slots 24' continues as an elongate channel 26, extending axially along the length of the spindle shaft portion 25; the other two slots 24 lead to longitudinal wall elements 27. An abutment 30 and a resilient spring finger (not visible) are disposed in the channel 26, and are provided to cooperate with the core disclosed in the above-identified Keller et al. patent; they serve no purpose in the assembly of the present invention.

As is best seen in FIGS. 2 and 5, the core is mounted on the spindle with one of the ribs 18' seated in the channel 26, the rib being of such constant width "W" that it engages the lateral wall elements defining the channel 26 with a significant level of friction, thereby producing a retentive force that resists relative axial movement of the core on the shaft. The remaining two ribs 18 bear upon the walls 27 of the shaft, and serve primarily to guide the core onto the shaft and to stabilize it in position; they are however identical to the rib 18' and each could be seated in the channel 26 to the same effect, depending upon the angular orientation of the core.

An additional component of holding force is generated by engagement of the circumferential contact surface elements 32, which discontinuously (i.e., as arcuate segments) surround the base of the frustoconical leading end portion 22 of the spindle, upon the contact surface 14 of the core; outer circumferential surface elements on the spindle shaft portion 25 also engage the contact surface 14. As will be appreciated, the radial thickness of the interference structure is such that the surface 14 grips the circumferential surfaces of the spindle to produce substantial resistance to relative movement, especially under the compressive force generated by a ribbon wound tightly upon the core; indeed, the relative dimensions are such that discernable expansion occurs along the interference structure 14 when the spindle surface elements bear thereagainst.

The ring-like stop element 16 provides a circumferential edge 17, disposed radially inwardly of the interference structure surface 14, that engages the frustoconical surface 22 of the leading end portion of the spindle (in circular line contact), thereby determining the depth to which the spindle can be inserted into the core. Needless to say, the position and dimensions of the ring-like element 16 are such that, when interengagement occurs, the surface elements of the spindle bear fully upon the surface of the interference structure.

In a specific embodiment of the invention, the ribbon core is constructed for use in a Monarch 9800 printer (Monarch Marking Systems, Inc.). For that application, the body of the core is about 4.3 inches long and about 1.5 inches in outside diameter. The cylindrical contact surface 14 is about 3.43 inches long, and has a diameter of about 1.13 inches; the lead-in section at the aft end of the core has a diameter of about 1.15 inch, and is about 1.6 inches long. The stop ring is positioned about 0.21 inch from the fore end of the core body, and has an axial length of about 0.12 inch and an inside diameter of about 1.0 inch; the bore forwardly thereof has a diameter of about 1.15 inch. The ribs on the core body are about 0.13 inch in circumferential width and extend from adjacent the stop ring to a point approximately 0.07 inch from the aft end of the body; the top surfaces of the ribs lie in an imaginary cylinder of about 0.98 inch diameter. Normally, the core will be fabricated from a synthetic resinous material, such as ABS copolymer, nylon, high impact polystyrene, or the like.

It will be appreciated that variations in the form and dimensions of the core of the invention, and of a spindle used in assembly therewith, may be made without departing from the scope of the appended claims. For example, the lead-in section of the bore might beneficially be even shorter than indicated (or indeed, it may be eliminated entirely), with the interference structure and cylindrical contact surface being correspondingly lengthened so as to maximize the stability of the core against canting on the shaft. Although the core is intended primarily for use with an inked ribbon roll in a printing machine, it will be appreciated that other web material may be wound upon the core for discharge and take-up, and for other applications, as may be appropriate.

Thus, it can be seen that the present invention provides a novel inked ribbon core, for use with a printing machine, that is of incomplex and economical construction, is readily mounted upon and dismounted from spindles of various forms, and that nevertheless enables reliable and stable positioning on the printer spindle while affording secure support for the ribbon wound thereupon. The invention also provides a novel core/spindle assembly affording such features and advantages.

Having thus described the invention, what is claimed is:

1. A spindle-mountable core for supporting a roll of web material, comprising:

a tubular body having opposite ends, an outer surface for receiving and supporting a length of web material wound thereupon, and an axial bore for receiving a spindle inserted into said body from one end;

a plurality of circumferentially spaced ribs extending axially along said bore and radially inwardly from said body, said ribs being constructed for slidable engagement with corresponding groove structure formed into the outer surface of a mounting spindle;

stop means, disposed on said body adjacent the opposite end thereof and within said bore, for engaging a spindle inserted into said bore from said one end so as to limit the depth of insertion of the spindle into said body and thereby define a fully mounted position of said core on the spindle; and interference structure providing a substantially cylindrical contact surface, effectively circumscribing said bore, for frictional engagement with circumferentially disposed external contact means on a spindle in said fully mounted position of said core thereon, said interference structure extending axially along a major portion of said bore from adjacent said stop means toward said one end of said body, said body additionally providing a lead-in section extending inwardly from said one end thereof, along a minor portion of said bore, said lead-in section providing a cylindrical inside surface having a diameter larger than the diameter of said substantially cylindrical contact surface.

2. The core of claim 1 wherein said interference structure is of substantially uniform radial thickness and wherein, except for being interrupted by said ribs, said substantially cylindrical contact surface is continuous.

3. The core of claim 1 wherein each of said ribs is of a uniform circumferential width along at least its entire effective length.

4. The core of claim 1 wherein said stop means comprises an engagement element spaced axially from said opposite end of said body.

5. The core of claim 4 wherein said engagement element comprises a circumferential shoulder disposed radially inwardly of said substantially cylindrical contact surface of said interference structure.

6. The core of claim 5 wherein ring structure effectively circumscribes said bore of said body and provides said circumferential shoulder, said ring structure being of substantially uniform thickness, greater than the thickness of said interference structure.

7. An assembly for supporting a roll of web material, comprising an elongate spindle comprised of a shaft portion and a forward end portion, each of said portions having circumferentially disposed external contact means thereon, said spindle having a plurality of groove structures that extend axially along at least said shaft portion and that open forwardly and radially outwardly thereof and a core, for supporting a roll of web material, disengageably mounted on said spindle, said core comprising:

a tubular body having opposite ends, an outer surface for receiving and supporting a length of web material wound thereupon, and an axial bore for receiving said spindle inserted into said body from one end;

a plurality of circumferentially spaced ribs extending axially along said bore and radially inwardly from said body, said ribs being constructed for slidable engagement with said groove structures of said spindle;

stop means, disposed on said body adjacent the opposite end thereof and within said bore, engaging said spindle inserted into said bore from said one end thereof, limiting the depth of insertion of said spindle and thereby defining a fully mounted position of said core thereon; and interference structure providing a substantially cylindrical contact surface, effectively circumscribing said bore, frictionally engaging said circumferentially disposed external contact means on said each of said portions of said spindle in said fully mounted position of said core thereon, said interference structure extending axially along a major portion of said bore from adjacent said stop means toward said one end of said body surface, said body additionally providing a lead-in section extending inwardly from said one end thereof, along a minor portion of said bore, said lead-in section providing a cylindrical inside surface having a diameter larger than the diameter of said substantially cylindrical contact surface.

8. The assembly of claim 7 wherein said core is devoid of spindle-engaging elements other than said ribs, said stop means, and said substantially cylindrical contact surface.

9. The assembly of claim 7 wherein said interference structure is of substantially uniform radial thickness and wherein, except for being interrupted by said ribs, said substantially cylindrical contact surface is continuous.

10. The assembly of claim 7 wherein said stop means comprises an engagement element spaced axially from said opposite end of said body.

11. The assembly of claim 10 wherein said engagement element comprises a circumferential shoulder disposed radially inwardly of said contact surface of said interference structure.

12. The assembly of claim 11 wherein ring structure effectively circumscribes said bore of said body and provides said circumferential shoulder, said ring structure being of substantially uniform thickness, greater than the thickness of said interference structure, and providing said circumferential shoulder.

13. The assembly of claim 7 wherein said groove structure of said spindle defines at least one slot, and wherein at least one of said ribs is dimensioned to frictionally engage said one slot-defining groove structure in which said one rib is engaged, said one rib and said one slot-defining groove structure cooperating with said interference structure of said core and said circumferentially disposed extemal contact means on said spindle for retention of said core on said spindle in said fully mounted core position.

14. The assembly of claim 13 wherein said core is retained on said spindle, against axial displacement, with a holding force of about 4 to 6 pounds.

15. The assembly of claim 13 wherein said at least one rib is of uniform circumferential width along at least its entire effective length.

16. An assembly for supporting a roll of web material, comprising an elongate, generally cylindrical spindle comprised of a shaft portion having outer circumferential elements along the length thereof, and a frustoconical leading end portion surrounded at its base by arcuate segments that provide circumferential contact surface elements, said spindle having a plurality of groove structures that extend axially along at least said shaft portion, that define at least one slot, and that open forwardly and radially outwardly thereof; and a core, for supporting a roll of web material, disengageably mounted on said spindle, said core comprising:

a tubular body having opposite ends, an outer surface for receiving and supporting a length of web material wound thereupon, and an axial bore for receiving said spindle inserted into said body from one end;

a plurality of circumferentially spaced ribs extending axially along said bore and radially inwardly from said body, said ribs being constructed for slidable engagement said groove structures of said spindle;

stop means, disposed on said body adjacent the opposite end thereof and within said bore, engaging said spindle inserted into said bore from said one end thereof, limiting the depth of insertion of said spindle and thereby defining the fully mounted position of said core thereon; and interference structure providing a substantially cylindrical contact surface, effectively circumscribing said bore and frictionally engaging said outer circumferential contact elements on said shaft portion and said circumferential contact surface elements surrounding said leading end portion of said spindle, in said fully mounted position of said core thereon, said interference structure extending axially along a major portion of said bore from adjacent said stop means toward said one end of said body, said at least one rib being of uniform circumferential width along at least its entire effective length and being engaged in said at least one slot, and said core being devoid of spindle-engaging elements other than said ribs, said stop means, and said substantially cylindrical contact surface, said body additionally defining a lead-in section extending inwardly from said one end thereof, along a minor portion of said bore, said lead-in section providing a cylindrical inside surface having a diameter larger than the diameter of said substantially cylindrical contact surface.

* * * * *